United States Patent [19]

Vanderheyden

[11] Patent Number: 4,860,466

[45] Date of Patent: Aug. 29, 1989

[54] ROTARY IRONING ROLLS WITH SERIAL FEED

[75] Inventor: Herman E. C. Vanderheyden, Aalter, Belgium

[73] Assignee: 501 E.M. D'Hooge N.V., Belgium

[21] Appl. No.: 210,404

[22] Filed: Jun. 23, 1988

[51] Int. Cl.[4] ..... D06F 65/10

[52] U.S. Cl. ..... 38/8; 38/55

[58] Field of Search ..... 38/55, 9, 143, 68, 57, 38/8; 198/607, 603

[56] References Cited

U.S. PATENT DOCUMENTS 4,411,082 10/1983 Ferrage ..... 38/9

FOREIGN PATENT DOCUMENTS 932879 8/1955 Fed. Rep. of Germany ..... 198/603

0198199 10/1985 Japan ..... 38/55

962486 7/1964 United Kingdom ..... 38/55

*Primary Examiner*—Andrew M. Falik

*Attorney, Agent, or Firm*—John P. Snyder

[57] ABSTRACT

Laundry ironing apparatus comprises sequential ironing rolls each associated with an ironing bed. A first conveyer feeds fresh laundry to the inlet zone of the first ironing roll and a scraper removes the pressed laundry from the periphery of the first roll at the outlet zone of such first roll onto a second conveyer which withdraws the pressed laundry from the outlet zone of the first ironing and feeds it into the inlet of the second roll which is located adjacent to the outlet zone of the first roll. The second conveyer withdraws and feeds in first and second stages, the first of which overlies the second roll and the second of which extends back under the first stage to the inlet zone of the second roll. The combined lengths of the first and second stages are such that pressed laundry is completely withdrawn from the first roll before it is fed to the second roll.

12 Claims, 1 Drawing Sheet

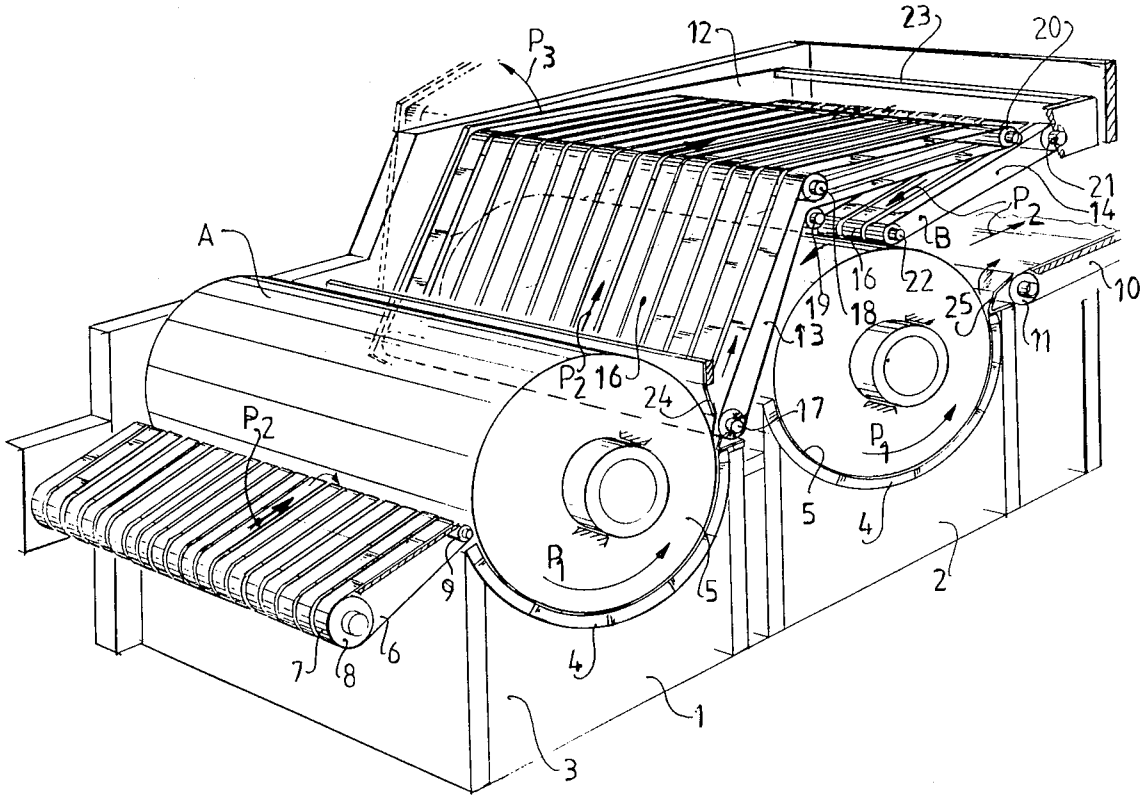
10
21
14
20
P2
2
11
25
2
23
B
22
P1
4
16
18
19
13
17
5
12
5
24
1
16
P2
P1
4
P3
3
9
6
8
7
P2
A

ROTARY IRONING ROLLS WITH SERIAL FEED

BACKGROUND OF THE INVENTION

The invention relates to an apparatus for ironing laundry, consisting substantially of at least two dished beds disposed adjacent and parallel to each other, each having a driven roll accommodated therein, in addition to a guide means for carrying the laundry out of the first dished bed into the following bed.

Such apparatus has its industrial application in companies which have to iron large quantities of laundry, such as sheets. The dished beds are heated by means of a heating medium, for instance oil or steam, whereby the roll serves to transport the laundry along the hot inner surface of the bed in order to dry and iron the laundry. It is already usual to arrange two or even three or four beds parallel to one another in order to subject the laundry to a multiple ironing treatment. The danger that may occur here is that the article for ironing is not carried properly from the one bed to the following one, this operation being performed up the present time by endless belts which run with the rolls. These belts or stripper tapes are susceptible to breakage and demand a relatively long repair time during which the ironing apparatus is out of operation.

BRIEF SUMMARY OF THE INVENTION

The invention has for its object to obviate this drawback and to provide an apparatus in which the throughput of laundry can take place undisturbed and in which the guide belts or stripper tapes are omitted.

The apparatus according to the invention is distinguished in that the guide means is a conveyor, the carrying surface of which extends at least above the following dished bed, in order to enlarge the take-up capacity.

The invention is based on the idea that the articles for ironing are not carried directly from the one dished bed into the other, but undergo interim storage on the conveyor, the carrying surface of which is so large that the article for ironing can be wholly removed from the previous dished bed before being fed into the following bed. Owing to the fact that the carrying surface extends above the beds, these latter can still be arranged close behind one another, so that the total length of the apparatus remains limited.

In one embodiment the conveyor takes the form of one or more successively linked endless conveyors, the running speeds of which differ from one another, the one being greater than the other.

As especially short total length of the apparatus with a large take-up capacity of laundry is achieved still better according to the invention by arranging two or more conveyors above one another.

In order to prevent laundry running back with the rolls at the delivery end of the dished bed, a linear scraper is arranged at least close to the first roll.

BRIEF DESCRIPTION OF THE DRAWING FIGURE

The invention is further elucidated in the following figure description of an emobidment. The annexed drawing shows a perspective top view of that embodiment provided with two parallel dished ironing beds.

DETAILED DESCRIPTION OF THE INVENTION

Indicated in each case in the figure by the numerals 1, 2 are the dished beds, each of which consists of a closed casing 3 which supports a cylinder-shaped ironing wall 4. This ironing wall 4 is heated by a heating vat supported underneath the ironing wall by the frame 3, which vat is provided with feed and discharge means for a heating medium, for example hot oil or steam. Such a dished bed is per se known in the art and falls otherwise outside the descriptionof the invention.

Arranged in the bed 1 is a roll 5 rotating in the direction of the arrow $P_1$ which is driven by means that are not further shown. Roll 5 can be of any appropriate and known construction and is often formed with a peripheral covering of molton such that the outer periphery of the roll is in contact with the hot inner wall 4 of the bed 1 over the whole throughput length. This can be further improved by giving the casing of roll 5 a flexible form. The construction of the roll is also per se known and falls further outside the scope of the invention.

Arranged on the front part of the foremost bed 1 is a feed conveyor 6, which consists of a number of parallel belts 7 wound around two reversing elements 8 and 9. One of the elements, preferably reversing element, 8 is driven such that the belts run in the direction of the arrow $P_2$.

Placed on the rear, or output side of the second dished bed 2, here the last one, is a discharge conveyor in the form of an endless belt, which is wound around reversing elements, of which only the first 11 is shown in the figure. This discharge conveyor leads for example to a folding device.

Fitted between both dished beds 1 and 2 is a guide means in the form of a conveyor 12. This conveyor 12 consists of two successively linked endless conveyors 13, 14 such that the in-feed side A of conveyor 13 is located at the discharge side of the first bed 1. The delivery side B of conveyor 14 is arranged close to the top part of the roll 5 of bed 2.

Each conveyor consists here of a number of parallel belts 16 which are guided via reversing elements 17, 18, 19 and 20. Conveyor 13 has a folded form, whereby it is worth noting that the first part runs relatively steeply upward and the second part runs virtually horizontally.

The second conveyor 14 also consists of endless belts 16, which are wound around two reversing elements 21, 22. It should be noted here that reversing element 21 lies, as seen in the transporting direction, further rearwrd relative to reversing element 20 of the first belt, so that the article of laundry is transferred from the horizontal part of conveyor 16 onto the active part of the second conveyor 14 in the proximity of the rearmost reversing element 21.

Conveyors 13, 14 are supported in a bearing frame 23 which can pivot upward in the direction of the arrow $P_3$ relative to the frame or supporting frame of the dished beds 1 and 2. The upward position is indicated in the figure by the broken line. The axis of pivot of support frame 23 coincides with the axis of rotation of reversing element 17.

It is remarked finally that in this embodiment each roll 5 is provided with a linear scraper 24 ad 25 respectively which ensures that the article of laundry does not remain adhered to the periphery of roll 5 when this article has to be transferred to the respective conveyors 16 and 10.

The above described apparatus operates as follows:

When the drive motors (not shown) are started the rolls 5 will begin to rotate in the direction of the arrow $P_1$ and the belts 7, 16 of the conveyors 6, 13, 14 and of conveyor 10 in the direction of arrow $P_2$.

As a result of being placed on the feed conveyor 6 the article of laundry will be fed through between the nip of the roll 5 and the heated wall 4 of the first dished bed 1 in the direction of arrow $P_2$ up to the linear scraper 24 whereby the leading edge of the article of laundry is lifted from roll 5 and carried over onto the upper part of the belts 16 of conveyor 13. The article of laundry is thus pulled out of the bed 1, whereby the leading edge of the article may already have reached conveyor 14. The laundry article is here transferred onto the upper part of the belts 16 of conveyor 14, whereby it is noted that the length of conveyor 13 and 14 according to the invention is dimensioned such that the article of laundry is completely pulled out of the dished bed 1 before it is fed into the bed 2. The leading edge and the article of laundry is then carried along via the upper part of roll 5 of the second dished bed and fed through between the nip of the heated wall 4 of the second bed and the roll 5 to undergo a further ironing treatment. The linear scraper 25 of the second dished bed 2 removed the article of laundry from the roll 5 and carries it over to conveyor 10. The thus dried and ironed article of laundry can then be carried away for further processing. It is remarked that in order to obtain a good stretching action on the article of laundry the speed of roll 5 in bed 1 can vary relative to that in bed 2, as can the transporting speed of the conveyors 13 and 14. The peripheral speed and conveyor speed preferably increase in each case so that the belt 13 runs more rapidly than roll 5 in dished bed 1, belt 14 more rapidly than belt 13 and the roll 5 of bed 2 more rapidly than belt 14.

The invention is not limited to the above described embodiment. The guide means between the first and second dished bed, here in the form of conveyor 13, 14, can take any suitable form different from the form of the conveyor with large take-up capacity of compressed disposition.

The belts 16 can also be replaced by wide belts or gauze belts.

I claim:

1. Apparatus for ironing laundry which comprises the combination of a pair of dished beds arranged in a series, a rotating and heated ironing roll nested in each dished bed to pass laundry between each roll and its bed to a region of discharge means for feeding fresh laundry to a first one of the rolls, means for withdrawing pressed laundry from the first one of the rolls and feeding it in a first feeding stage overhead of the second one of the rolls and then in a second feeding stage back downwardly to the second one of the rolls to an inlet zone disposed between the first and second rolls.

2. Apparatus as defined in claim 1 wherein the length of said means for withdrawing is sufficient to withdraw the pressed laundry completely from the first roll before feeding it to the second roll.

3. Apparatus as defined in claim 2 wherein said means for withdrawing comprises two or more conveyers arranged above one another.

4. Apparatus as defined in claim 1 wherein said means for withdrawing comprises two or more conveyers arranged above one another.

5. Apparatus as defined in claim 4 including first scraper means at the outlet zone of the first roll for preventing laundry from adhering to the periphery of the first roll, and second scraper means at the outlet zone of the second roll for preventing laundry from adhering to the periphery of the second roll.

6. Apparatus as defined in claim 1 including first scraper means at the outlet zone of the first roll for preventing laundry from adhering to the periphery of the first roll, and second scraper means at the outlet zone of the seond roll for preventing laundry from adhering to the periphery of the second roll.

7. Apparatus for ironing laundry which comprises the combination of a pair of dished beds arranged in a series, a first rotating and heated ironing roll nested in one dished bed to define an inlet zone on one side of the bed remote from the other dished bed and an outlet zone on the other side of the bed adjacent the other dished bed, a second rotating and heated ironing roll nested in the other dished bed to define an inlet zone adjacent the outlet zone of the first bed and an outlet zone on the opposite side of the other bed, means for feeding fresh laundry to the inlet zone of the first one of the rolls, means for withdrawing pressed laundry from the outlet zone of the first one of the rolls and feeding it in a first feeding stage overhead of the second roll and then in a second feeding stage back downwardly to the inlet zone of the second roll.

8. Apparatus as defined in claim 7 wherein the length of said means for withdrawing is sufficient to withdraw the pressed laundry completely from the first roll before feeding it to the second roll.

9. Apparatus as defined in claim 8 wherein said means for withdrawing comprises two or more conveyers arranged above one another.

10. Apparatus as defined in claim 7 wherein said means for withdrawing comprises two or more conveyers arranged above one another.

11. Apparatus as defined in claim 10 including first scraper means at the outlet zone of the first roll for preventing laundry from adhering to the periphery of the first roll, and second scraper means at the outlet zone of the second roll for preventing laundry from adhering to theperiphery of the second roll.

12. Apparatus as defined in claim 7 including first scraper means at the outlet zone of the first roll for preventing laundry from adhering to the periphery of the first roll, and second scraper means at the outlet zone of the second roll for preventing laundry from adhering to the periphery of the second roll.

* * * * *